US011614105B2

(12) United States Patent
Roeben

(10) Patent No.: US 11,614,105 B2
(45) Date of Patent: Mar. 28, 2023

(54) METHOD OF MONITORING AN ELECTROHYDROSTATIC ACTUATOR

(71) Applicant: Liebherr-Aerospace Lindenberg GmbH, Lindenberg (DE)

(72) Inventor: Tobias Roeben, Lindenberg (DE)

(73) Assignee: Liebherr-Aerospace Lindenberg GmbH, Lindenberg (DE)

( * ) Notice: Subject to any disclaimer, the term of this patent is extended or adjusted under 35 U.S.C. 154(b) by 0 days.

(21) Appl. No.: 17/547,054

(22) Filed: Dec. 9, 2021

(65) Prior Publication Data

US 2022/0186755 A1 Jun. 16, 2022

(30) Foreign Application Priority Data

Dec. 10, 2020 (DE) ..... 10 2020 133 020.0

(51) Int. Cl.
*F15B 19/00* (2006.01)
*F15B 11/08* (2006.01)

(52) U.S. Cl.
CPC ..... *F15B 19/005* (2013.01); *F15B 11/08* (2013.01)

(58) Field of Classification Search
CPC ..... F15B 21/087; F15B 2211/20515; F15B 19/005; F15B 11/08; F15B 15/18; F15B 9/03
See application file for complete search history.

(56) References Cited

U.S. PATENT DOCUMENTS 7,191,593 B1 * 3/2007 Ho ..... B64C 13/504 60/473

FOREIGN PATENT DOCUMENTS

DE 102013005417 A1 10/2014
DE 102015008754 A1 1/2017
KR 20100111339 A * 10/2010 ..... F15B 9/03

* cited by examiner

*Primary Examiner* — Abiy Teka
*Assistant Examiner* — Daniel S Collins
(74) *Attorney, Agent, or Firm* — McCoy Russell LLP

(57) ABSTRACT

The disclosure relates to a method of monitoring an electrohydrostatic actuator, wherein the electrohydrostatic actuator comprises a hydraulic pump drivable by an electric motor and a hydraulic activator drivable by means of the hydraulic pump to move a component, in particular an aircraft part. The method include detecting the instantaneous speed of the electric motor; detecting an instantaneous position of the activator; detecting a parameter that relates to an instantaneous operating point of the electrohydrostatic actuator; determining a state variable relating to an efficiency of the electrohydrostatic actuator on the basis of at least the detected speed and the detected position in dependence on the detected parameter; and determining a state of the electrohydrostatic actuator on the basis of the currently determined value.

20 Claims, 3 Drawing Sheets

METHOD OF MONITORING AN ELECTROHYDROSTATIC ACTUATOR

CROSS REFERENCE TO RELATED APPLICATION

The present application claims priority to German Patent Application No. 10 2020 133 020.0 filed on Dec. 10, 2020. The entire contents of the above-listed application are hereby incorporated by reference for all purposes.

TECHNICAL FIELD

The present disclosure relates to a method of monitoring an electrohydrostatic actuator having a hydraulic pump drivable by an electric motor and a hydraulic activator drivable by means of the hydraulic pump to move a component, in particular an aircraft component, and to a vehicle, in particular an aircraft, having a control unit to carry out the method in accordance with the disclosure, and to a computer program product to carry out the method in accordance with the disclosure.

BACKGROUND

Hydraulic servo actuators are typically used in flight control systems. They generate an altitude change via the change of hydraulic pressure in hydraulic cylinders that ultimately enables the actuation of control surfaces. The servo actuators here are controlled with the aid of a central hydraulic system. Since they have to provide all the aircraft parts to be moved continuously with a high minimum pressure, a high hydraulic power is required. In addition, hydraulic lines have to be laid to each of the parts to be moved.

SUMMARY

In the course of the electrification of aircraft systems (also called "more electric aircraft"), electrohydrostatic actuators (EHAs) are also increasingly being used for this purpose that provide local hydraulic system for supplying the individual hydraulic actuators and that are electronically controlled. EHAs as a rule comprise a hydraulic pump, typically in the form of an axial piston pump that is driven by an electric motor and that hydraulically drives a hydraulic activator, e.g. a piston-in-cylinder unit. The control or regulation of the EHA takes place electronically.

The "more electric aircraft" makes ever higher demands on the performance (service life) of electrical (power-by-wire) actuators. Due to the complexity of electromechanical actuators and of EHAs, this technology initially only provides a limited availability. In addition to the support of the drive shaft, in particular the tribocontacts within the axial piston pump are affected by wear in an EHA. EHAs or their components have to be subjected to regular inspection and service intervals for this reason.

A wide variation in the actual performance may also result for a design that is robust per se due to varying operating conditions and production tolerances. The operation of EHAs in current platforms is only provided, due to a lack of experience with this technology and to the high criticality of their function in flight control, if the conventional flight control based on servo hydraulics fails (back-up mode).

As long as the robustness of EHAs has not been demonstrated in a representative environment and in permanent operation (that is in long-term applications), the flight control of civil aircraft will also continue to be substantially limited to servo actuators. Central hydraulic system having an unfavorable energetic balance and a complex architecture will thus also be significantly required in the future for energy supply. At the same time, the full potential of the EHA technology cannot be exploited.

Against this background, the present disclosure has set itself the object of improving the reliability of such electrohydrostatic actuators. Technical safety and financial risks of an unplanned failure should in particular be minimized here.

This object is achieved in accordance with the disclosure. Embodiments of the disclosure result from the following description.

A method is accordingly proposed of monitoring an electrohydrostatic actuator, wherein the latter comprises a hydraulic pump drivable by an electric motor and a hydraulic activator drivable by means of the hydraulic pump to move a component, in particular an aircraft part. The method in accordance with the disclosure comprises the following steps:

detecting the instantaneous speed of the electric motor;

detecting an instantaneous position of the activator;

detecting a parameter that relates to an instantaneous operating point of the electrohydrostatic actuator;

determining a state variable relating to an efficiency of the electrohydrostatic actuator on the basis of at least the detected speed and the detected position in dependence on the detected parameter; and determining a state of the electrohydrostatic actuator on the basis of the currently determined value and, in some embodiments, of the plurality of previously determined values of the state variable.

The above steps do not have to be carried out in a fixed order or necessarily after one another. The detection of the speed, the position, and/or the parameter can thus, for example, take place simultaneously or in any desired other order.

More precisely, it is not the state variable itself that is determined, but its value. For reasons of simplicity, however, the determination of the state variable is simply spoken of here. The same applies to the detection of the parameter and of other values to which reference is made here.

The fact that the term "hydraulic activator" and not "hydraulic actuator" is used in the present case is purely for linguistic reasons and is intended to improve ease of reading. The distinction between "actuator" and "activator" has no technical significance.

The advantage of the approach in accordance with the disclosure for a state determination based on efficiency is the possibility of being able to use EHAs over longer periods of use in safety-critical primary flight control and of simultaneously avoiding the risk of an unplanned and so expensive failure.

On a use of a plurality of EHAs monitored in accordance with the disclosure in a vehicle, it is furthermore possible both to identify the variation of the hydraulic pump characteristics due to production over the individual produced EHAs and to determine robustness data on the respective application (for example as an elevator, rudder, or aileron in an aircraft and with respect to the aircraft type).

The EHA technology can optionally be developed so far by the continuous detection of operating data that it enables a purely electrically operated flight control and thus renders the lossy central hydraulic supply obsolete.

The determination of the state variable takes place here in dependence on the detected parameter. It is thereby possible to carry out the monitoring only in certain situations or in a presence of certain operating points or ranges in the performance map of the EHA (or of the hydraulic pump) and thereby to avoid a recording of erroneous data or of data with only limited significance. The reliability of the state monitoring is thereby considerably increased. Service work can be planned better and unnecessary work can be avoided on the basis of this state monitoring.

In some embodiments, the instantaneous speed of the electric motor can be measured via an angle transmitter. The hydraulic activator may be a piston-in-cylinder unit, with the instantaneous position relating to the extended position of the piston. It is in particular measured via a position encoder. The detection of the parameter can likewise take place by means of sensors or via a tapping of signals already available to the control.

The processing of the detected data, the determination of the efficiency, and the determination of the state may take place via a control that can comprise one or more control units.

Provision is made in a possible embodiment that an instantaneous speed or setting speed of the activator is calculated from the detected instantaneous position of the activator and is used as the basis for determining the state variable. The instantaneous speed can be determined via the differentiation or derivation of a position encoder signal representing the instantaneous position. In some embodiments, the underlying position signal can be filtered to improve the measurement. The setting speed can naturally also be measured directly by means of a suitable speed sensor.

Provision is made in a further possible embodiment that the state variable determined at least on the basis of the detected speed and on the detected position in dependence on the detected parameter is an efficiency of the electrohydrostatic actuator. It is here in particular the volumetric efficiency of the hydraulic pump that substantially depends on the speed and on the conveying volume of the hydraulic pump and on the hydraulic volume moved by means of the activator per time unit (with a piston-in-cylinder unit, the moved volume flow results from the piston cross-section and the setting speed).

A conclusion can be drawn on a state of the electrohydrostatic actuator on the basis of the efficiency determined (and on preceding efficiency determinations). A degeneration of the volumetric efficiency of the hydraulic pump thus, for example, indicates its progressing wear that can inter alia result from clearances increasing in size due to abrasion. The output of an error signal can take place in response to the state recognition.

Provision is made in a further possible embodiment that the parameter is or relates to an instantaneous power implemented in the electrohydrostatic actuator. In some embodiments, it is the power implemented in the hydraulic pump that is determined using a detected pressure difference, in particular a pressure difference between the input side and the output side of the hydraulic pump. The power implemented at the instantaneous operating point can be calculated together with the volume flow conveyed by the hydraulic pump. This power substantially corresponds to the power implemented by the activator.

A certain finite power has to be implemented for a significant determination of the volumetric efficiency of the hydraulic pump. An including of the pumping capacity therefore provides that only representative values of the efficiency are detected and used as the basis for the determination of the state. The pressure difference is ideally measured by means of a plurality of pressure sensors at the hydraulic lines of the intake side and pressure side. The measured pressure difference can flow together with the measured volume flow (that is in particular the measured pump speed in combination with the value of the nominal displacement volume known to the control) into an activation logic that checks whether sufficient power is implemented in the hydraulic pump or in the activator and whether therefore the corresponding instantaneously detected value can be used for the further analysis/state recognition.

Provision is made in a further possible embodiment that the determination of the state variable only takes place when the parameter exceeds or falls below an activation limit value. The activation limit can in particular be a minimum power that is implemented in the hydraulic pump or in the activator.

Provision is made in a further possible embodiment that the activation limit value is or relates to a minimal power implemented in the electrohydrostatic actuator and/or that the determination of the state variable takes place at a stationary operating point of the electrohydrostatic actuator, in particular of the hydraulic pump.

Provision is made in a further possible embodiment that the determination of the state variable takes place multiple times during the operating period of the electrohydrostatic actuator, in particular at regular time intervals and/or on the occurrence of a certain event such as a starting of the machine in which the electrohydrostatic actuator is installed. The values of the state variable detected via the operating period of the electrohydrostatic actuator can thereby be used for a trend analysis and conclusions can be drawn from them with respect to the state of the electrohydrostatic actuator for the future. On a use of a plurality of electrohydrostatic actuators, the values or trends of the individual actuators can be compared with one another.

The variance cause by the production of the hydraulic pump characteristics can thus, for example, be identified or robustness data on the respective application can be determined (that is the state data in dependence on the respective applications or environmental conditions of the individual electrohydrostatic actuators—e.g. on the use of the electrohydrostatic actuator as an elevator, rudder, or aileron in an aircraft). This in turn helps in the identification of any weak points and in the improvement of the EHA technology.

Provision is made in a further possible embodiment that the values of the determined state variable are stored, with a trend being determined on the basis of an analysis of the stored values and with a forecast being prepared therefrom relating to the state variable and/or the state of the electrohydrostatic actuator. It can here be wear of the electrohydrostatic actuator or of the hydraulic pump or of the activator (optionally also of the electric motor).

Provision is made in a further possible embodiment that a time for a replacement, a repair, and/or a service of the electrohydrostatic actuator or of one of its components, in particular of the hydraulic pump and/or of the activator, is determined. A statement can thus, for example, be made from the reduction of the volumetric efficiency of the hydraulic pump on when it has to be replaced or repaired. The servicing times can thus be planned at an early time and unplanned failures can be prevented.

Provision is made in a further possible embodiment that an error state is recognized when a certain number of determined values, in particular values determined after one another, of the state variable falls below or exceeds a threshold value. If, for example, the value of the determined volumetric efficiency of the hydraulic pump permanently (that is for a certain time or for a certain number of measurements) falls below a certain threshold value, an error message can be output. This can in turn be used as a cause for the planning of a service intervention.

Provision is made in a further possible embodiment that the certain state of the electrohydrostatic actuator relates to a wear state of the electrohydrostatic actuator, in particular to a wear state of the hydraulic pump. It can likewise be a wear state of the activator and/or of the electric motor.

Provision is made in a further possible embodiment that the hydraulic pump is an axial piston machine, which may have a constant displacement volume. An adjustable axial piston machine can, however, also be used as the pump in which the currently conveyed hydraulic volume is measured directly, for example by detecting the current pivot angle and the instantaneous speed of the shaft driving the pump or of the electric motor. Provision can alternatively or additionally be made that the hydraulic activator is a piston-in-cylinder unit. It can be an aircraft part such as an elevator, rudder, or aileron.

The present disclosure further relates to a vehicle, in particular an aircraft, having at least one electrohydrostatic actuator, by means of which a vehicle component, in particular an aircraft component, is movable and that is controllable by means of a control, wherein the control unit is configured to carry out the method in accordance with the disclosure. In this respect, the same properties obviously result as for the method in accordance with the disclosure so that a repeat description will be dispensed with at this point.

Provision is made in a possible embodiment that the vehicle component is an aircraft component of the primary or secondary flight control, with a further redundant or diverse actuator being provided in addition to the electrohydrostatic actuator to move the aircraft component. It is, for example, conceivable to use the electrohydrostatic actuator as a secondary drive (i.e. in back-up mode) in addition to a servo actuator controllable via a central hydraulic system. The electrohydrostatic actuator could, however, also be used as the primary drive due to the state monitoring in accordance with the disclosure and the fail safety and plannability resulting therefrom.

The present disclosure further relates to a computer program product for monitoring an electrohydrostatic actuator that comprises a hydraulic pump drivable by an electric motor and a hydraulic activator drivable by means of the hydraulic pump to move a component, in particular an aircraft component, wherein the computer program product is adapted to carry out the method in accordance with the disclosure on an execution by a computer, in particular by control unit of a vehicle such as an aircraft control. In this respect, the same properties also obviously result as for the method in accordance with the disclosure so that a repeat description will be dispensed with at this point.

BRIEF DESCRIPTION OF THE FIGURES

Further features and details of the disclosure result from the embodiments explained in the following with reference to the Figures. There are shown

DETAILED DESCRIPTION

As a result of their function, electrohydrostatic actuators (EHAs) provide a number of sensors and its control electronics with the possibility over actuators having an analog interface with the flight control computer of also taking over the functions of the state monitoring in addition to the position regulation. Safety-critical error cases are thus already recognized and intercepted by the actuator itself today.

Figure 1:
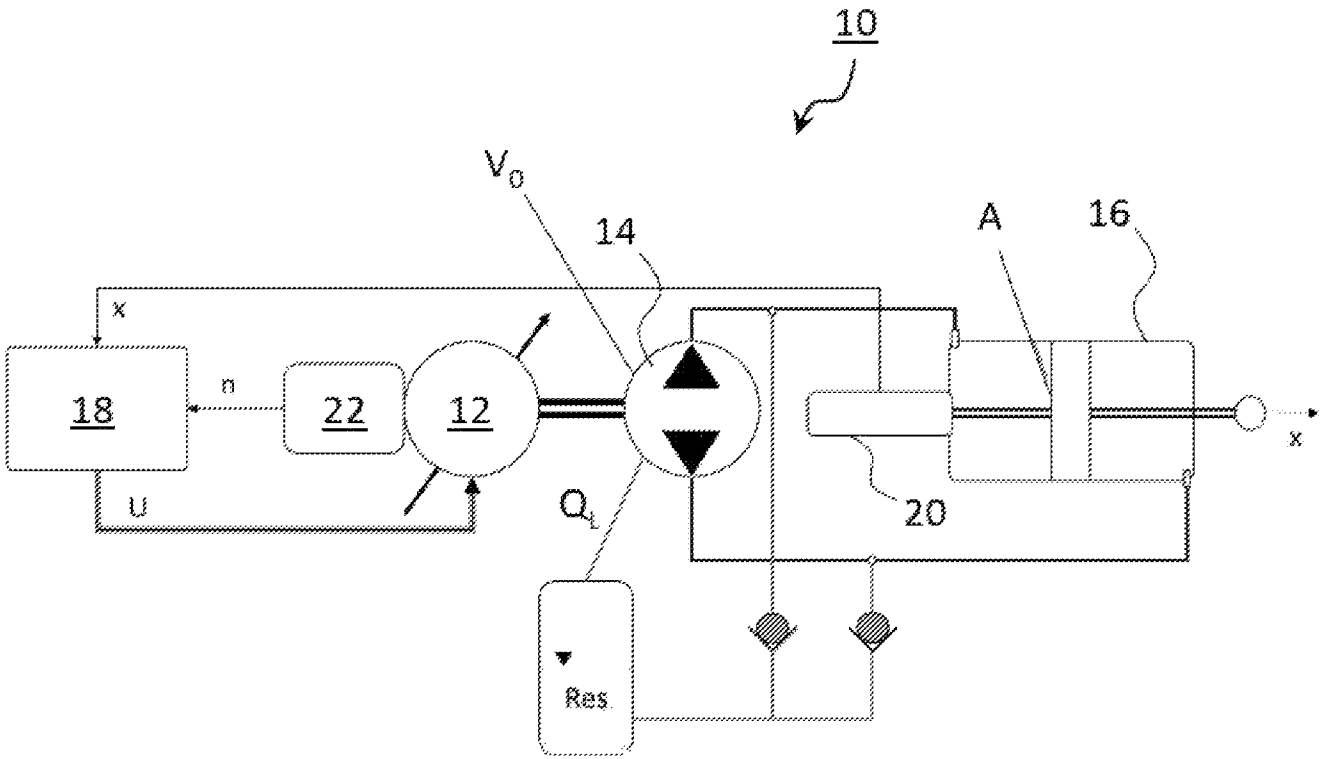
FIG. 1: a schematic representation of the electrohydrostatic actuator in accordance with the disclosure in accordance with an embodiment.

FIG. 1 schematically shows the design and the functional principle of an embodiment of the EHA 10 in accordance with the disclosure. The latter comprises a hydraulic pump 14 that is designed as an axial piston machine having an unchangeable displacement volume $V_0$ and is driven via a drive shaft by an electric motor 12 at a speed n. The electric motor 12 is electrically controlled by a control unit 18 (control signal U). The volume flow $Q_{theoretical}=n\cdot V_0$, where $V_0$ is the nominal displacement volume of the axial piston machine 14, theoretically conveyed by the pump 14 can be set by the setting of a certain value for the speed n.

The values (A, $V_0$) relevant to the balancing of the volume flow Q are also given in FIG. 1. A leak volume flow $Q_L$ (shown as a connection to a hydraulic oil reservoir Res) is adopted in dependence on the wear state of the pump 14. All the values required for determining the efficiency $\eta_{vol}$, that is in particular the speed n (detected via an angle transmitter 22) and the setting speed $\dot{x}$ (detected via a position encoder 20 and a subsequent differentiation) are evaluated and further processed in the control electronics or control unit 18.

The hydraulic pump 14 hydraulically drives an activator 16 that is designed as a piston-in-cylinder unit and that moves a component, for example an elevator, rudder, or aileron, of an aircraft. The piston of the activator 16 has a diameter A so that the stroke of the piston results with the setting speed $\dot{x}=dx/dt$ to $A\cdot\dot{x}$. This approximately corresponds to the volume flow $Q_{effective}$ conveyed by the hydraulic pump 14.

The control electronics of the EHA 10 provides the possibility of monitoring the wear state of the axial piston pump 14. The volumetric efficiency $\eta_{vol}$, that falls as the wear progresses (in particular due to the clearances increasing in size due to abrasion) as the running time increases serves as a significant feature here. The volumetric efficiency $\eta_{vol}$ can be approximately calculated as follows:

$$\eta_{vol} = \frac{Q_{effective}}{Q_{theoretical}} = \frac{A\dot{x}}{V_0 n}.$$

It must, however, be noted here that an EHA in the primary flight control is typically operated far away from its design values and in oscillating cycles. The volumetric efficiency $\eta_{vol}$ should, however, ideally be determined at a stationary operating point at which a finite power is implemented since otherwise a singularity is present.

$$\lim_{n\to 0}\eta_{vol}(n) \to \infty.$$

The applied external load is also decisive, in addition to the speed range, in the efficiency determination since the leak of the pump 14 is decisively defined by the pressure potential via the gaps.

It becomes clear that a certain power has to be implemented at the activator 16 to determine a significant value. The efficiency calculation is therefore dependent on the operating state. Dynamic effects (compression, pulsation) are furthermore neglected in this approach.

Figure 2:
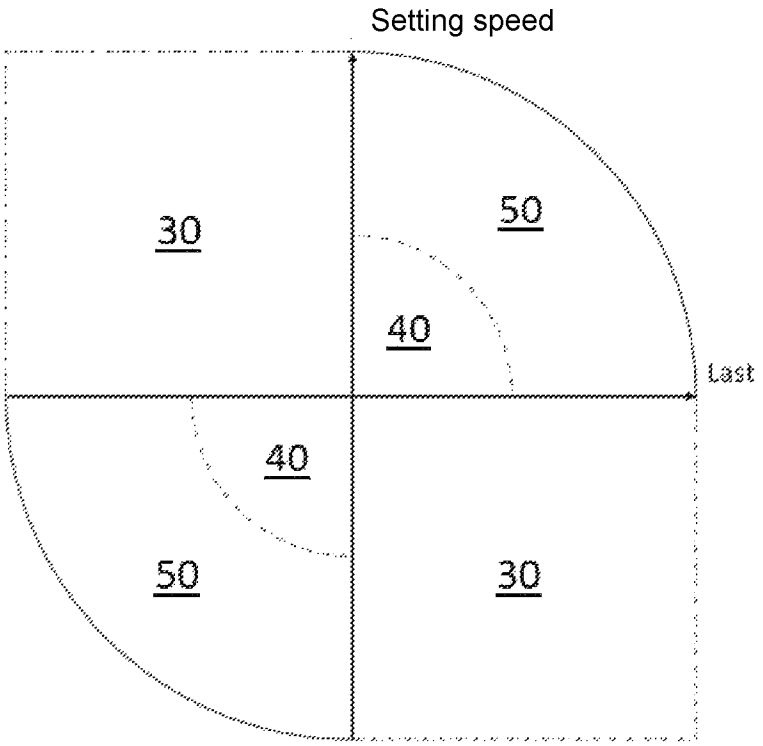
FIG. 2: a schematic representation of the relationship between the setting speed and the load of the activator with respect to the implemented power.

This relationship is shown in FIG. 2, where the setting speed $\dot{x}$ of the actuator 16 is applied (y axis) against the applied load (x axis). Generator operation lof the activator 16, in which an external force drives the electric motor 12 and thereby generates power, is present in the second and fourth quadrants 30, that are of no further interest here. The first and third quadrans relevant to the function of the EHA 10 as a drive are divided into regions of lower power 40 (close to the origin) and regions of higher power 50. In other words, those operating points of the EHA 10 that are in the range 50 correspond to an operation in which the axial piston machine 14 implements a power sufficient for the evaluation of the volumetric efficiency $\eta_{vol}$.

In addition to the dependence on the respective operating point, the volumetric efficiency $\eta_{vol}$ also varies on the basis of production tolerances. The efficiency $\eta_{vol}$ furthermore typically initially briefly increases in operation or during the running-in procedure and thereupon reaches an optimum. Starting from this reference value that is specific to the actuator, a progressing wear can then be recognized in further operation after the running-in process.

Figure 3:
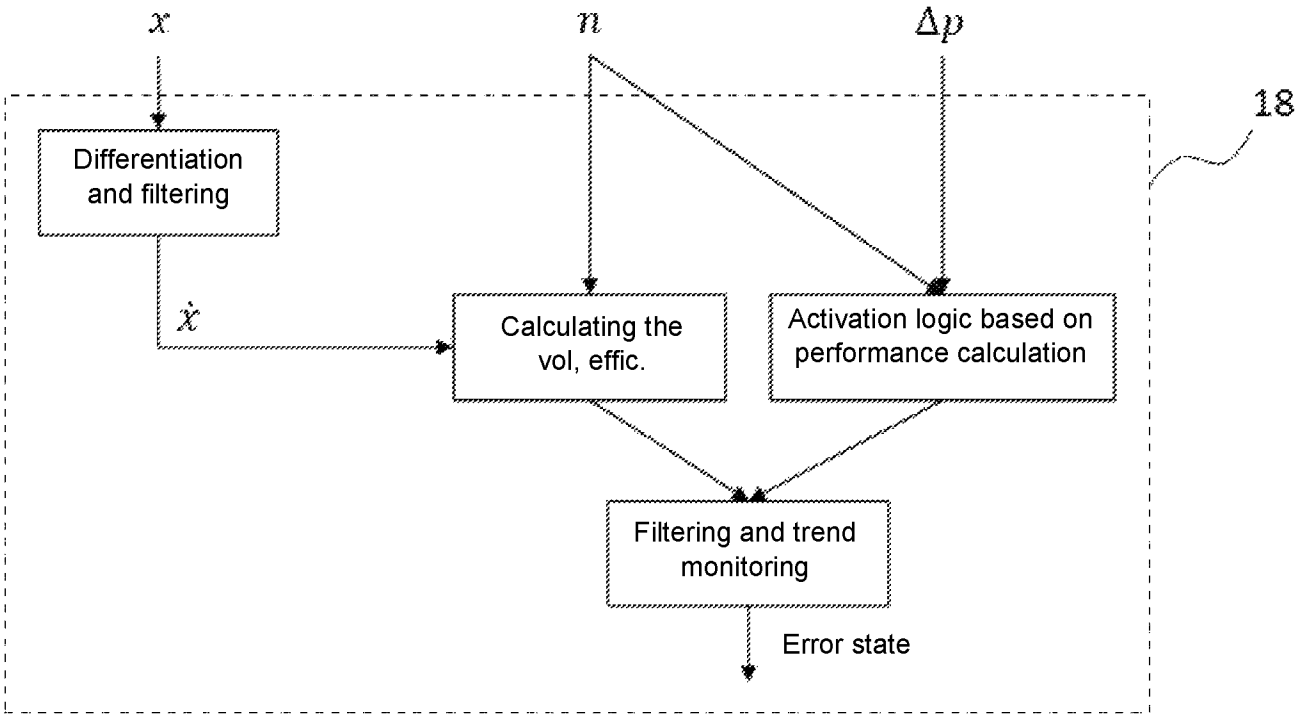
FIG. 3: a schematic representation of the steps of the method in accordance with the disclosure in accordance with an embodiment.

FIG. 3 schematically describes the routine in the determination of an error state on the basis of a degradation of the volumetric efficiency $\eta_{vol}$: As described above, the calculation of the efficiency $\eta_{vol}$ also requires, beside the speed of the electric motor 12, a differentiation and filtering of the position encoder signal representing the instantaneous piston position x to obtain the linear setting speed $\dot{x}$ of the activator 16. In parallel with this, the motor speed n and the differential pressure $\Delta p$ present at the pump flow into an activation logic that checks in accordance with FIG. 2 whether sufficient power is implemented in the activator 16 that is required for an unambiguous determination of the efficiency $\eta_{vol}$ (that is whether the instantaneous operating point is in the range 50).

If this is the case, the calculated efficiency value is used for the further trend analysis. A filter here in turn provides that outliers are neglected and a long-term trend is instead recognized. The robustness of the monitor or of the evaluation/monitoring is hereby ensured. If the calculated efficiency $\eta_{vol}$ permanently falls below a defined threshold value, the installed hydraulic pump 14 is deemed to be defective and an error state is output. This can in turn be taken as a reason for the planning of a servicing intervention, whereby an unheralded failure of the EHA 10 at a later time is avoided.

The above-described steps are carried out by the control unit 18 that receives the signals required for the calculation of the efficiency $\eta_{vol}$. The control unit 18 can be a central control (e.g. an aircraft control) or a control locally assigned to the respective EHA 10. The control unit may include memory having instructions stored therein for receiving input from one or more sensors coupled in an aircraft such as the various parameters described herein. Further, the control unit may also include instructions stored in memory for adjusting one or more actuators coupled in the aircraft, such as the various actuators described herein.

REFERENCE NUMERAL LIST

10 electrohydrostatic actuator (EHA)
12 electric motor
14 hydraulic pump (axial piston machine)
16 hydraulic activator (piston-in-cylinder unit)
18 control unit
20 position decoder
22 angle transmitter
30 range, generator operation
40 range, lower power
50 range, higher/sufficient power
$\Delta p$ pressure difference
A piston surface
n speed
Res reservoir
U control signal
x position
$\dot{x}$ speed

The invention claimed is:

1. A method of monitoring an electrohydrostatic actuator that comprises a hydraulic pump drivable by an electric motor and a hydraulic activator drivable by means of the hydraulic pump to move a component, the method comprising the steps:

detecting an instantaneous speed of the electric motor;

detecting an instantaneous position of the hydraulic activator;

detecting a parameter that relates to an instantaneous operating point of the electrohydrostatic actuator;

determining a state variable relating to an efficiency of the electrohydrostatic actuator on the basis of at least the detected speed and the detected position in dependence on the detected parameter; and determining a state of the electrohydrostatic actuator on the basis of a currently determined value of the state variable.

2. The method in accordance with claim 1, wherein an instantaneous speed of the activator is calculated from the detected instantaneous position and is used as the basis for determining the state variable.

3. The method in accordance with claim 1, wherein the state variable is an efficiency of the electrohydrostatic actuator.

4. The method in accordance with claim 1, wherein the parameter is or relates to an instantaneous power implemented in the electrohydrostatic actuator.

5. The method in accordance with claim 1, wherein the determination of the state variable only takes place when the parameter exceeds or falls below an activation limit value.

6. The method in accordance with claim 5, wherein the activation limit value is or relates to a minimal power implemented in the electrohydrostatic actuator; and/or in that the determination of the state variable takes place at a stationary operating point of the electrohydrostatic actuator.

7. The method in accordance with claim 5, wherein the determination of the state variable takes place multiple times during an operating period of the electrohydrostatic actuator.

8. The method in accordance with claim 7, wherein the values of the determined state variable are stored, with a trend being determined on the basis of an analysis of the stored values and with a forecast being prepared therefrom relating to the state variable and/or the state of the electrohydrostatic actuator.

9. The method in accordance with claim 8, wherein a time for a replacement, a repair, and/or a service of the electrohydrostatic actuator or of one of its components is determined.

10. The method in accordance with claim 7, wherein an error state is recognized when a certain number of determined values of the state variable falls below or exceeds a threshold value.

11. The method in accordance with claim 1, wherein a certain state of the electrohydrostatic actuator relates to a wear state of the electrohydrostatic actuator.

12. The method in accordance with claim 1, wherein the hydraulic pump is an axial piston machine and/or in that the hydraulic activator is a piston-in-cylinder unit.

13. A vehicle having at least one electrohydrostatic actuator by means of which an component is movable and that is controllable by means of a control unit, with the control unit being configured to carry out the method in accordance with claim 1.

14. The vehicle in accordance with claim 13, wherein the vehicle component is an aircraft component of the primary or secondary flight control.

15. A computer program product for monitoring the electrohydrostatic actuator that comprises the hydraulic pump drivable by the electric motor and the hydraulic activator drivable by means of the hydraulic pump to move the component, wherein the computer program product is adapted to carry out the method in accordance with one of the claim 1, on an execution by a computer.

16. The method in accordance with claim 1, wherein the component is an aircraft part.

17. The method in accordance with claim 3, wherein the state variable is a volumetric efficiency of the hydraulic pump.

18. The method in accordance with claim 4, wherein the instantaneous power being determined based on a detected pressure difference, wherein the power parameters are determined based on a pressure difference between the input side and the output side of the hydraulic pump.

19. The method in accordance with claim 9, wherein the component is an electrohydrostatic actuator component that is the hydraulic pump and/or the activator.

20. The method in accordance with claim 12, wherein the axial piston machine has a constant displacement volume ($V_0$).

* * * * *